US010578323B2

(12) United States Patent
Aguilar

(10) Patent No.: US 10,578,323 B2
(45) Date of Patent: Mar. 3, 2020

(54) SYSTEMS FOR DEHUMIDIFYING AIR AND METHODS OF ASSEMBLING THE SAME

(71) Applicant: General Electric Company, Schenectady, NY (US)

(72) Inventor: Jose Francisco Aguilar, Queretaro (MX)

(73) Assignee: General Electric Company, Schenectady, NY (US)

( * ) Notice: Subject to any disclaimer, the term of this patent is extended or adjusted under 35 U.S.C. 154(b) by 300 days.

(21) Appl. No.: 15/466,357

(22) Filed: Mar. 22, 2017

(65) Prior Publication Data

US 2018/0274803 A1 Sep. 27, 2018

(51) Int. Cl.

| | |
|---|---|
| ***B01D 49/00*** | (2006.01) |
| ***B01D 39/00*** | (2006.01) |
| ***B01D 41/00*** | (2006.01) |
| ***B01D 45/00*** | (2006.01) |
| ***B01D 46/00*** | (2006.01) |
| ***B01D 50/00*** | (2006.01) |
| ***B01D 51/00*** | (2006.01) |
| ***F24F 3/14*** | (2006.01) |

(52) U.S. Cl.

CPC ..... *F24F 3/14* (2013.01); *F24F 2003/1446* (2013.01)

(58) Field of Classification Search

None

See application file for complete search history.

(56) References Cited

U.S. PATENT DOCUMENTS

| | | | | |
|---|---|---|---|---|
| 3,271,935 | A * | 9/1966 | Smith | B01D 5/0006 165/111 |
| 4,662,907 | A | 5/1987 | Yoshida | |
| 4,848,988 | A | 7/1989 | Suzuki | |
| 5,236,474 | A * | 8/1993 | Schofield | B01D 53/22 95/47 |
| 5,509,275 | A * | 4/1996 | Bhatti | B60H 3/024 165/7 |
| 5,746,791 | A | 5/1998 | Wang | |
| 5,878,590 | A * | 3/1999 | Kadle | B60H 3/024 165/165 |
| 5,906,108 | A | 5/1999 | Kidwell | |
| 6,755,037 | B2 | 6/2004 | Engel et al. | |

(Continued)

*Primary Examiner* — Amber R Orlando
*Assistant Examiner* — Phillip Y Shao
(74) *Attorney, Agent, or Firm* — Armstrong Teasdale LLP

(57) ABSTRACT

A dehumidifier assembly includes an extraction chamber coupled in flow communication with a sample air inlet, a sample air outlet, and a sample drip opening. The extraction chamber is configured to receive a sample air flow therethrough at substantially atmospheric pressure from the sample air inlet to the sample air outlet. The dehumidifier assembly also includes a conduit positioned within the extraction chamber. The conduit is coupled in flow communication with an environmental air inlet and an environmental air outlet, and is sealed with respect to the extraction chamber. The dehumidifier assembly further includes a circulator coupled to the environmental air outlet. The circulator is operable to create a negative pressure in the conduit, such that an environmental air flow is drawn through the environmental air inlet into the conduit. The conduit is configured to facilitate heat transfer from the sample air flow to the environmental air flow.

20 Claims, 3 Drawing Sheets

(56) References Cited

U.S. PATENT DOCUMENTS

| | | | | |
|---|---|---|---|---|
| 7,010,929 | B2 | 3/2006 | Kidwell | |
| 7,017,365 | B2 | 3/2006 | Haas et al. | |
| 7,093,454 | B2 | 8/2006 | Kidwell | |
| 2002/0134544 | A1* | 9/2002 | DeVilbiss | F24F 5/0042 165/287 |
| 2008/0034717 | A1 | 2/2008 | Yun | |
| 2012/0118155 | A1* | 5/2012 | Claridge | B01D 53/268 96/9 |
| 2012/0168119 | A1* | 7/2012 | Dunnavant | F24F 3/14 165/59 |

* cited by examiner

SYSTEMS FOR DEHUMIDIFYING AIR AND METHODS OF ASSEMBLING THE SAME

BACKGROUND

The field of the disclosure relates generally to dehumidification and, more particularly, to an air dehumidifier assembly for use with a gas detection system.

At least some known enclosures, such as, but not limited to, enclosures associated with a gas turbine, include a gas detection system to detect any potential gas leakage within the enclosure. For example, the gas turbine includes fuel gas control valves and fuel gas stop ratio valves housed in the enclosure, and the gas detection system is configured to examine air samples from the enclosure to detect any potential fuel gas leakage within the enclosure. A temperature and humidity of the air sample can vary due to, for example, a geographic location of the enclosure and/or seasonal changes. In some locations, a temperature of the air in the enclosure may drop below approximately 45 degrees Fahrenheit, for example. Such relatively low temperatures may cause moisture within the air to form into ice under air sampling flow conditions, which may disrupt the operation and/or damage the components of the gas detection system, requiring an unscheduled shutdown of the gas turbine to remove the ice and/or repair the detection system. Dehumidifiers may be used to reduce a potential for ice formation in the detection system, however, known dehumidifiers require compression of the sampled air flow, which increases a cost and complexity of the gas detection system.

BRIEF DESCRIPTION

In one aspect, a dehumidifier assembly is provided. The dehumidifier assembly includes an extraction chamber coupled in flow communication with each of a sample air inlet, a sample air outlet, and a sample drip opening. The extraction chamber is configured to receive a sample air flow therethrough at substantially atmospheric pressure from the sample air inlet to the sample air outlet. The dehumidifier assembly also includes a conduit positioned within the extraction chamber. The conduit is coupled in flow communication with an environmental air inlet and an environmental air outlet, and is sealed with respect to the extraction chamber. The dehumidifier assembly further includes a circulator coupled to the environmental air outlet. The circulator is operable to create a negative pressure in the conduit, such that an environmental air flow is drawn through the environmental air inlet into the conduit. The conduit is configured to facilitate heat transfer from the sample air flow to the environmental air flow.

In another aspect, a gas detection system for an enclosure is provided. The gas detection system includes a gas detection device and a dehumidifier assembly. The dehumidifier assembly includes an extraction chamber that includes a sample air inlet coupled in flow communication with an interior cavity of the enclosure, a sample air outlet coupled in flow communication with the gas detection device, and a sample drip opening. The gas detection device is configured to receive a sample air flow at substantially atmospheric pressure from the sample air outlet. The dehumidifier assembly also includes a conduit positioned within the extraction chamber. The conduit is coupled in flow communication with an environmental air inlet and an environmental air outlet, and is sealed with respect to the extraction chamber. The dehumidifier assembly further includes a circulator coupled to the environmental air outlet. The circulator is operable to create a negative pressure in the conduit, such that an environmental air flow is drawn through the environmental air inlet into the conduit. The conduit is configured to facilitate heat transfer from the sample air flow to the environmental air flow.

In another aspect, a method of assembling a dehumidifier assembly for a gas detection system is provided. The method includes coupling a sample air inlet of an extraction chamber in flow communication with an interior cavity of an enclosure, and coupling a sample air outlet of the extraction chamber in flow communication with a gas detection device. The gas detection device is configured to receive a sample air flow at substantially atmospheric pressure from the sample air outlet. The extraction chamber further includes a sample drip opening. The method also includes positioning a conduit within the extraction chamber such that the conduit is sealed with respect to the extraction chamber. The conduit is coupled in flow communication with an environmental air inlet and an environmental air outlet. The method further includes coupling a circulator to the environmental air outlet. The circulator is operable to create a negative pressure in the conduit, such that an environmental air flow is drawn through the environmental air inlet into the conduit. The conduit is configured to facilitate heat transfer from the sample air flow to the environmental air flow.

DETAILED DESCRIPTION

The exemplary systems and methods described herein include a dehumidifier assembly that does not require compression in order to dehumidify air sampled from an enclosure. The embodiments include an extraction chamber coupled in flow communication with the enclosure to receive sampled air, and a conduit positioned within the extraction chamber and sealed with respect to the extraction chamber. Ambient air is circulated through the conduit to provide a heat exchange medium for condensing moisture from the sampled air. The dehumidified air may then be provided at substantially atmospheric pressure to, for example, a gas detection device.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Approximating language may be applied to modify any quantitative representation that could permissibly vary without resulting in a change in the basic function to which it is related. Accordingly, a value modified by a term or terms, such as "about," "approximately," and "substantially," is not to be limited to the precise value specified. In at least some instances, the approximating language may correspond to the precision of an instrument for measuring the value. Here and throughout the specification and claims, range limitations may be identified. Such ranges may be combined and/or interchanged, and include all the subranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

Figure 1:
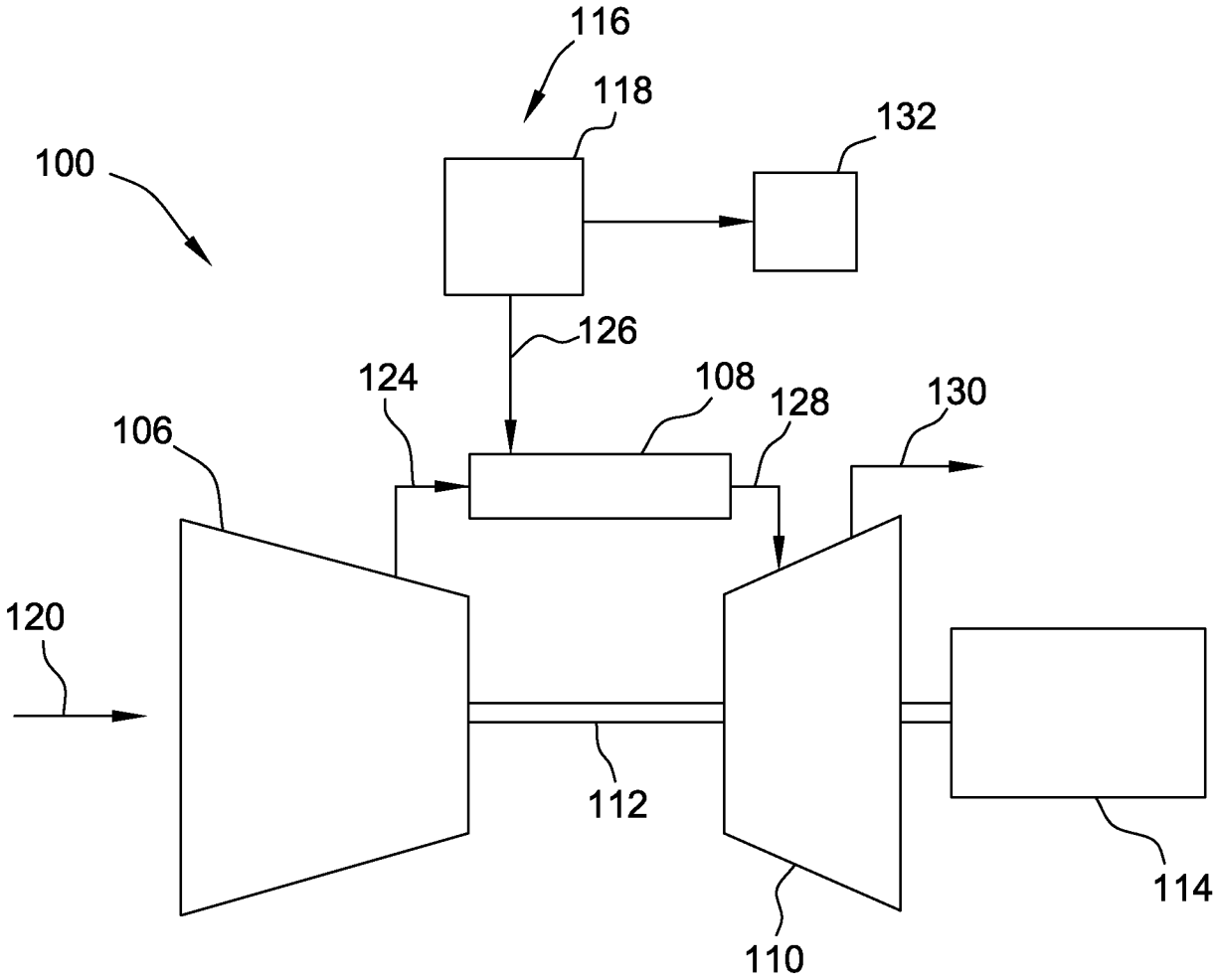
FIG. 1 is a block diagram of an exemplary power plant including an enclosure.

FIG. 1 is a schematic illustration of an exemplary gas turbine 100. In the exemplary embodiment, gas turbine 100 includes a compressor 106, a combustor section 108, and a turbine 110. Turbine 110 is coupled to compressor 106 via a rotor assembly 112. It should be noted that, as used herein, the term "couple" is not limited to a direct mechanical, electrical, and/or communication connection between components, but may also include an indirect mechanical, electrical, and/or communication connection between multiple components. Gas turbine 100 is further coupled to a load 114, for example, an electric generator, via rotor assembly 112. Gas turbine 100 further includes a fuel system 116 in serial-flow relationship with combustor section 108.

In the exemplary embodiment, fuel system 116 includes an enclosure 118 which houses, for example, fuel gas control valves (not shown) associated with fuel system 116. In alternative embodiments, enclosure 118 houses any suitable portion of gas turbine 100. In other alternative embodiments, enclosure 118 is not associated with any portion of gas turbine 100, but rather houses any type of system or component that is suitable for use with embodiments of dehumidifier assembly 200 (shown in FIG. 2).

Enclosure 118 defines an interior cavity 136. In the exemplary embodiment, interior cavity 136 is coupled in flow communication with a gas detection system 132. For example, but not by way of limitation, fuel system 116 supplies natural gas as fuel 126, and gas detection system 132 is configured to direct sampled air to a gas detection device 133 (shown in FIG. 2) operable to detect a concentration of natural gas. Although gas detection system 132 is illustrated as positioned externally to enclosure 118, in certain embodiments, at least a portion of gas detection system 132 is housed within interior cavity 136.

In operation of gas turbine 100, intake air 120 is drawn into compressor 106. Intake air 120 is at ambient air temperature. Compressor 106 compresses intake air 120 to higher pressures and temperatures prior to it being discharged as compressed air 124 towards combustor section 108. Compressed air 124 is mixed with fuel 126 supplied from fuel system 116 and the resulting mixture is burned within combustor section 108, generating combustion gases 128 that are directed towards turbine 110. Turbine 110 converts thermal energy within combustion gases 128 to mechanical rotational energy that is used to drive rotor assembly 112. A portion of the rotational energy is used to drive compressor 106, and the balance is used to drive load 114, for example to generate electric power. A hot exhaust gas mixture 130 is discharged from turbine 110 and, for example, channeled to either the atmosphere or to a Heat Recovery Steam Generator (not shown).

Figure 2:
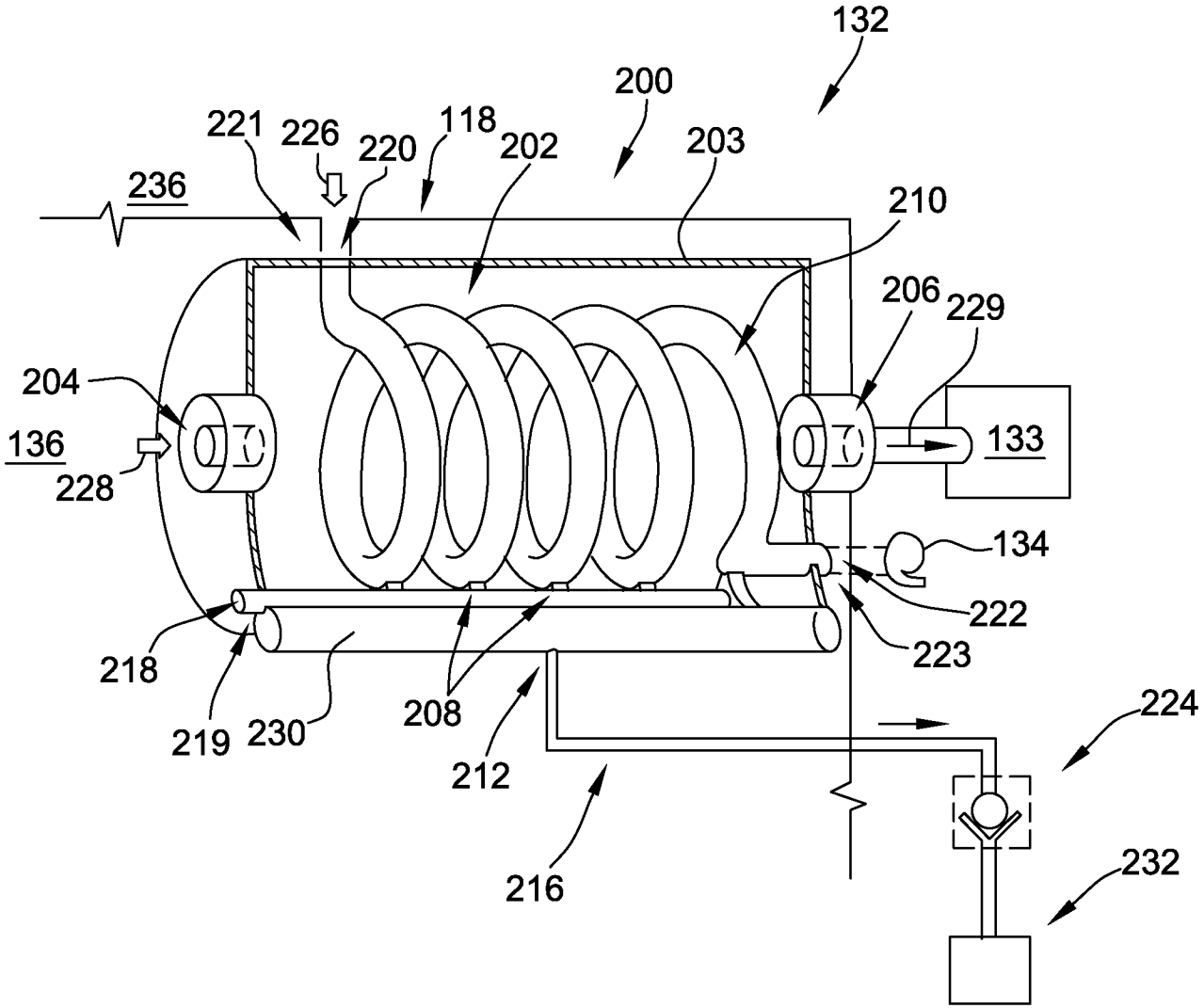
FIG. 2 is a perspective cutaway illustration of an exemplary dehumidifier assembly that may be used with the enclosure illustrated in FIG. 1.

FIG. 2 is a perspective cutaway illustration of an exemplary dehumidifier assembly 200 that may be used with gas detection system 132. In alternative embodiments, dehumidifier assembly 200 is used with any suitable system that benefits from a supply of dehumidified air. In the exemplary embodiment, dehumidifier assembly 200 includes an extraction chamber 202 defined generally by a hollow casing 203. Extraction chamber 202 is coupled in flow communication with a sample air inlet 204, a sample air outlet 206, and a sample drip opening 212. Sample air inlet 204 receives inlet sample air flow 228 from interior cavity 136 of enclosure 118 at substantially atmospheric pressure, and sample air outlet provides outlet sample air flow 229 at substantially atmospheric pressure to a suitable gas detection device 133. Sample drip opening 212 provides an outlet from extraction chamber 202 for water condensed from inlet sample air flow 228 as it flows through extraction chamber 202, such that outlet sample air flow 229 is dehumidified relative to inlet sample air flow 228. In the exemplary embodiment, extraction chamber 202 includes one each of sample air inlet 204, sample air outlet 206, and sample drip opening 212, such that extraction chamber 202 defines a closed flow path, but for sample drip opening 212, between sample air inlet 204 and sample air outlet 206. In alternative embodiments, extraction chamber 202 includes any suitable number of each of sample air inlet 204, sample air outlet 206, and sample drip opening 212 that enables dehumidifier assembly 200 to function as described herein. In some embodiments, sample air inlet 204 and/or sample air outlet 206 are selectively opened and closed to facilitate batch sampling and processing of air from interior cavity 136 within extraction chamber 202.

In the exemplary embodiment, casing 203 is a generally cylindrical hollow casing. In alternative embodiments, casing 203 has any suitable shape that enables extraction chamber 202 to function as described herein. In the exemplary embodiment, sample air inlet 204 and sample air outlet 206 are positioned on opposing ends of extraction chamber 202, such that sample air flows substantially axially through extraction chamber 202. In alternative embodiments, sample air inlet 204 and sample air outlet 206 are positioned in any suitable fashion that enables dehumidifier assembly 200 to function as described herein. In the exemplary embodiment, casing 203 is positioned within interior cavity 136 of enclosure 118. In alternative embodiments, casing 203 is positioned at least partially outside interior cavity 136 of enclosure 118.

Sample drip opening 212 is positioned proximate to a bottommost point, with respect to a direction of gravity, of extraction chamber 202. For example, in the exemplary embodiment, casing 203 includes a trough 230 positioned along a bottom edge of casing 203 and coupled in flow communication with extraction chamber 202, such that trough 230 is positioned to accumulate water droplets condensed from sample air flow 228 within extraction chamber 202 and pulled downward by gravity. Sample drip opening 212 is coupled in flow communication with trough 230 to facilitate drainage of the accumulated water from trough 230. In alternative embodiments, casing 203 does not include trough 230, and sample drip opening 212 is positioned in any suitable fashion that enables dehumidifier assembly 200 to function as described herein.

In exemplary embodiment, sample drip opening 212 is coupled in flow communication with a sample drain 216. In turn, sample drain 216 is coupled in flow communication with a sample water accumulation tank 232. Water in sample water accumulation tank 232 is treated and/or disposed of in any suitable fashion that enables dehumidifier assembly 200 to function as described herein. Further in the exemplary embodiment, sample drain 216 includes a suitable check valve 224 positioned downstream from sample drip opening 212 and upstream from tank 232. Check valve 224 is configured to enable flow of accumulated water from sample drain 216 to tank 232, while inhibiting backflow of air from tank 232 to extraction chamber 202. More specifically, check valve 224 inhibits air from tank 232 from mixing with and/or diluting sample air flow 228, ensuring that gas detection device 133 operates solely on air sampled from enclosure 118. In alternative embodiments, condensed water flow through sample drip opening 212 is handled in any suitable fashion that enables dehumidifier assembly 200 to function as described herein.

Dehumidifier assembly 200 further includes a conduit 210 positioned within extraction chamber 202 and extending therethrough. Conduit 210 is coupled in flow communication with an environmental air inlet 220, an environmental air outlet 222, and an environmental drain 218. Environmental air inlet 220 receives inlet environmental air flow 226 from ambient air 236 external to enclosure 118, and environmental air outlet 222 is coupled in flow communication to a circulator 134. Environmental drain 218 provides an outlet from conduit 210 for water condensed from environmental air flow 226 as it flows through conduit 210. In the exemplary embodiment, conduit 210 includes one each of environmental air inlet 220, environmental air outlet 222, and environmental drain 218, such that conduit 210 defines a closed flow path, but for environment drain 218, between environmental air inlet 220 and environmental air outlet 222. In alternative embodiments, conduit 210 includes any suitable number of each of environmental air inlet 220, environmental air outlet 222, and environmental drain 218 that enables dehumidifier assembly 200 to function as described herein.

Conduit 210 is sealed with respect to extraction chamber 202, such that conduit 210 is not in flow communication with extraction chamber 202, inlet sample air flow 228, or outlet sample air flow 229. For example, in the exemplary embodiment, conduit 210 at environmental air inlet 220 extends through a first substantially sealed port 221 defined in casing 203, environmental air outlet 222 extends through a second substantially sealed port 223 defined in casing 203, and environmental drain 218 extends through a third substantially sealed port 219 defined in casing 203. Conduit 210 facilitates heat exchange between environmental air flow 226 and sample air flow 228 through a wall of conduit 210, such that outlet sample air flow 229 is not mixed with, or diluted by, environmental air flow 226, ensuring that gas detection device 133 operates solely on air sampled from enclosure 118.

In the exemplary embodiment, conduit 210 is a generally coil-shaped, thin-walled hollow tube. In alternative embodiments, conduit 210 has any suitable shape and structure that enables dehumidifier assembly 200 to function as described herein. In the exemplary embodiment, environmental air inlet 220 and environmental air outlet 222 are positioned on opposing ends of conduit 210, such that environmental air 226 flows through a coiled path through extraction chamber 202, facilitating increased heat exchange with sample air flow 228 through the thin wall of conduit 210. In alternative embodiments, environmental air inlet 220 and environmental air outlet 222 are positioned in any suitable fashion that enables dehumidifier assembly 200 to function as described herein.

Environmental drain 218 is positioned proximate to a bottommost point, with respect to a direction of gravity, of conduit 210. For example, in the exemplary embodiment, conduit 210 includes a plurality of drip openings 208 each positioned along a bottom edge of a respective coil of conduit 210 and coupled in flow communication with environmental drain 218, such that environmental drain 218 is positioned to accumulate water droplets condensed within conduit 210 and pulled downward by gravity. Environmental drain 218 is coupled in flow communication with any suitable sink (not shown) for water condensed from environmental air flow 226. In alternative embodiments, conduit 210 does not include plurality of drip openings 208, and environmental drain 218 is positioned in any suitable fashion that enables dehumidifier assembly 200 to function as described herein.

Environmental air outlet 222 is coupled in flow communication with circulator 134. Circulator 134 is operable to create a negative pressure within conduit 210, such that environmental air flow 226 is drawn into environmental air inlet 220, through conduit 210, and through environmental air outlet 222. In the exemplary embodiment, circulator 134 is a vacuum pump. In alternative embodiments, circulator 134 is an exhaust fan or any other suitable device that enables dehumidifier assembly 200 to function as described herein. Additionally, in certain embodiments, circulator 134 is part of a pre-existing ventilation system for enclosure 118, such that dehumidifier assembly 200 does not require purchase and installation of a separate circulator 134, thereby reducing a cost of dehumidifier assembly 200. In alternative embodiments, circulator 134 is dedicated to use with dehumidifier assembly 200.

During operation, circulator 134 creates a negative pressure within conduit 210 such that environmental air flow 226 is drawn into environmental air inlet 220, through conduit 210, and through environmental air outlet 222. Simultaneously, gas detection system 132 operates to draw sample air flow 228 at substantially atmospheric pressure into sample air inlet 204, through extraction chamber 202, and out of sample air outlet 206 into gas detection device 133. Due to, for example, a presence of heat-generating mechanical and/or electronic equipment within enclosure 118, a temperature of the air within interior cavity 136 of enclosure 118 drawn into sample air flow 228 is typically warmer than a temperature of ambient air 236 drawn into environmental air flow 226. Thus, heat tends to be transferred from sample air flow 228 to environmental air flow 226 through a wall of conduit 210. A resulting drop in temperature of sample air flow 228 causes at least a portion of the humidity in sample air flow 228 to condense before sample air flow 228 exits extraction chamber 202 as outlet sample air flow 229. Moreover, dehumidifier assembly 200 does not require any compression of sample air flow 228, such that outlet sample air flow 229 is provided to gas detection device 133 at substantially atmospheric pressure. As such, dehumidifier assembly 200 facilitates an efficient process for dehumidifying outlet sample air flow 229 at substantially atmospheric pressure before outlet sample air flow 229 reaches gas detection device 133. In alternative embodiments, dehumidifier assembly 200 is used in conjunction with any other suitable system that benefits from receiving dehumidified air flow at substantially atmospheric pressure.

Although condensation most typically occurs from sample air flow 228, in the exemplary embodiment, dehumidifier assembly 200 includes environmental drain 218, as described above, in the event that condensation occurs in environmental air flow 226.

Figure 3:
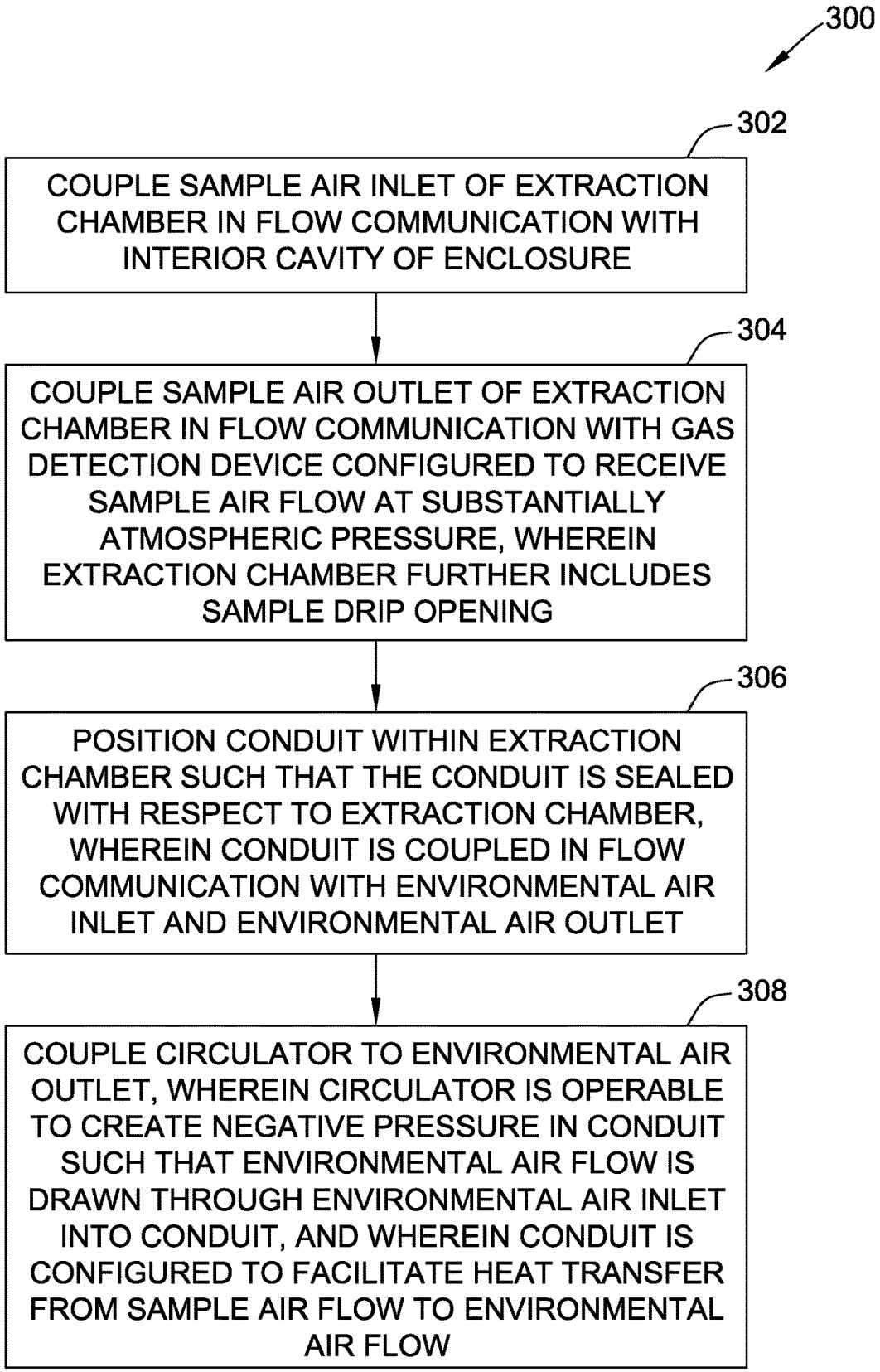
FIG. 3 is a block diagram of an exemplary method of assembling a dehumidifier assembly, such as the exemplary assembly shown in FIG. 2.

FIG. 3 is a flow diagram of an exemplary method 300 of assembling a dehumidifier assembly, such as dehumidifier assembly 200, for a gas detection system, such as gas detection system 132. With reference also to FIGS. 1 and 2, in the exemplary embodiment, method 300 includes coupling 302 a sample air inlet of an extraction chamber, such as sample air inlet 204 of extraction chamber 202, in flow communication with an interior cavity of an enclosure, such as interior cavity 136 of enclosure 118. Method 300 also includes coupling 304 a sample air outlet of the extraction chamber, such as sample outlet 206, in flow communication with a gas detection device. The gas detection device, such as gas detection device 133, is configured to receive a sample air flow at substantially atmospheric pressure from the sample air outlet. The extraction chamber further includes a sample drip opening, such as sample drip opening 212.

In the exemplary embodiment, method 300 further includes positioning 306 a conduit, such as conduit 210, within the extraction chamber such that the conduit is sealed with respect to the extraction chamber. The conduit is coupled in flow communication with an environmental air inlet and an environmental air outlet, such as environmental air inlet 220 and environmental air outlet 222. Additionally, method 300 includes coupling 308 a circulator to the environmental air outlet. The circulator, such as circulator 134, is operable to create a negative pressure in the conduit, such that an environmental air flow is drawn through the environmental air inlet into the conduit. The conduit is configured to facilitate heat transfer from the sample air flow to the environmental air flow.

The above-described embodiments overcome at least some disadvantages of known dehumidification systems. Specifically, the embodiments facilitate dehumidification of sampled air without any requirement to compress the sampled air. Also specifically, the embodiments described herein facilitate the use of ambient air as a heat exchange medium, eliminating a need for a dedicated coolant storage and supply system. As a result, the embodiments facilitate reducing or eliminating formation of ice in a gas detection system, while reducing installation and maintenance costs and a mechanical complexity of the system.

Exemplary embodiments of dehumidifier assemblies and methods of assembling the same are described above in detail. The apparatus, systems, and methods described are not limited to the specific embodiments described herein, but rather, components of the systems and apparatus and/or steps of the method may be utilized independently and separately from other components and/or steps described herein. For example, the embodiments may also be used in combination with other systems and methods, and are not limited to practice with a gas turbine as described herein. Rather, the embodiments can be implemented and utilized in connection with many other systems.

Although specific features of various embodiments may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

This written description uses examples, including the best mode, to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dehumidifier assembly comprising:

an extraction chamber coupled in flow communication with each of a sample air inlet, a sample air outlet, and a sample drip opening, said extraction chamber configured to receive a sample air flow therethrough at substantially atmospheric pressure from said sample air inlet to said sample air outlet;

a conduit positioned within said extraction chamber, said conduit is coupled in flow communication with an environmental air inlet and an environmental air outlet, said conduit is sealed with respect to said extraction chamber; and a circulator coupled to said environmental air outlet, said circulator operable to create a negative pressure in said conduit, such that an environmental air flow is drawn through said environmental air inlet into said conduit, wherein said conduit is configured to facilitate heat transfer from the sample air flow to the environmental air flow.

2. The dehumidifier assembly in accordance with claim 1, wherein said environmental air inlet is configured to receive ambient air as the environmental air flow and said sample air inlet is configured to receive air from within an enclosure as the sample air flow, such that a temperature of the sample air flow is warmer than a temperature of the environmental air flow.

3. The dehumidifier assembly in accordance with claim 1, wherein said conduit comprises a generally coil-shaped, hollow tube.

4. The dehumidifier assembly in accordance with claim 1, wherein said circulator comprises a vacuum pump.

5. The dehumidifier assembly in accordance with claim 1, wherein said sample drip opening is positioned proximate to a bottommost point of said extraction chamber.

6. The dehumidifier assembly in accordance with claim 1, further comprising a trough coupled in flow communication with said extraction chamber, said trough is positioned to accumulate water droplets condensed from the sample air flow within said extraction chamber, said sample drip opening is coupled in flow communication with said trough to facilitate drainage of the accumulated water from said trough.

7. The dehumidifier assembly in accordance with claim 1, wherein said extraction chamber is defined by a casing, said environmental air inlet extends through a first substantially sealed port defined in said casing, and said environmental air outlet extends through a second substantially sealed port defined in said casing.

8. The dehumidifier assembly in accordance with claim 1, further comprising an environmental drain coupled in flow communication with said conduit, said environmental drain comprises an outlet from said conduit for water condensed from the environmental air flow within said conduit.

9. The dehumidifier assembly in accordance with claim 1, wherein said sample drip opening is coupled in flow communication with a sample drain, said sample drain comprises a check valve positioned downstream from said sample drip opening and configured to inhibit backflow of air to said extraction chamber.

10. A gas detection system for an enclosure, said gas detection system comprising:

a gas detection device; and a dehumidifier assembly comprising:

an extraction chamber comprising a sample air inlet coupled in flow communication with an interior cavity of the enclosure, a sample air outlet coupled in flow communication with said gas detection device, and a sample drip opening, said gas detection device configured to receive a sample air flow at substantially atmospheric pressure from said sample air outlet;

a conduit positioned within said extraction chamber, said conduit is coupled in flow communication with an environmental air inlet and an environmental air outlet, said conduit is sealed with respect to said extraction chamber; and a circulator coupled to said environmental air outlet, said circulator operable to create a negative pressure in said conduit, such that an environmental air flow is drawn through said environmental air inlet into said conduit, wherein said conduit is configured to facilitate heat transfer from the sample air flow to the environmental air flow.

11. The system in accordance with claim 10, wherein said conduit comprises a generally coil-shaped, hollow tube.

12. The system in accordance with claim 10, wherein said sample drip opening is positioned proximate to a bottommost point of said extraction chamber.

13. The system in accordance with claim 10, further comprising a trough coupled in flow communication with said extraction chamber, said trough is positioned to accumulate water droplets condensed from the sample air flow within said extraction chamber, said sample drip opening is coupled in flow communication with said trough to facilitate drainage of the accumulated water from said trough.

14. The system in accordance with claim 10, wherein said extraction chamber is defined by a casing, said environmental air inlet extends through a first substantially sealed port defined in said casing, and said environmental air outlet extends through a second substantially sealed port defined in said casing.

15. The system in accordance with claim 10, further comprising an environmental drain coupled in flow communication with said conduit, said environmental drain comprises an outlet from said conduit for water condensed from the environmental air flow within said conduit.

16. The system in accordance with claim 10, wherein said sample drip opening is coupled in flow communication with a sample drain, said sample drain comprises a check valve positioned downstream from said sample drip opening and configured to inhibit backflow of air to said extraction chamber.

17. A method of assembling a dehumidifier assembly for a gas detection system, said method comprising:

coupling a sample air inlet of an extraction chamber in flow communication with an interior cavity of an enclosure;

coupling a sample air outlet of the extraction chamber in flow communication with a gas detection device, wherein the gas detection device is configured to receive a sample air flow at substantially atmospheric pressure from the sample air outlet, and wherein the extraction chamber further includes a sample drip opening;

positioning a conduit within the extraction chamber such that the conduit is sealed with respect to the extraction chamber, wherein the conduit is coupled in flow communication with an environmental air inlet and an environmental air outlet; and coupling a circulator to the environmental air outlet, wherein the circulator is operable to create a negative pressure in the conduit, such that an environmental air flow is drawn through the environmental air inlet into the conduit, and wherein the conduit is configured to facilitate heat transfer from the sample air flow to the environmental air flow.

18. The method in accordance with claim 17, wherein said positioning the conduit comprises positioning a generally coil-shaped, hollow tube.

19. The method in accordance with claim 17, further comprising coupling an environmental drain in flow communication with the conduit, wherein the environmental drain comprises an outlet from the conduit for water condensed from the environmental air flow within the conduit.

20. The method in accordance with claim 17, further comprising coupling the sample drip opening in flow communication with a sample drain, wherein the sample drain includes a check valve positioned downstream from the sample drip opening and configured to inhibit backflow of air to the extraction chamber.

* * * * *